US008011901B2

(12) United States Patent
Duncan

(10) Patent No.: US 8,011,901 B2
(45) Date of Patent: Sep. 6, 2011

(54) DISCHARGE PRESSURE ACTUATED PUMP

(75) Inventor: Grant Duncan, Calgary (CA)

(73) Assignee: Suncor Energy Inc. (CA)

( * ) Notice: Subject to any disclaimer, the term of this patent is extended or adjusted under 35 U.S.C. 154(b) by 1220 days.

(21) Appl. No.: 11/530,848

(22) Filed: Sep. 11, 2006

(65) Prior Publication Data

US 2008/0080990 A1 Apr. 3, 2008

(51) Int. Cl.
*F04B 9/08* (2006.01)

(52) U.S. Cl. ..... 417/390; 417/378; 417/399; 417/402; 166/372; 166/373

(58) Field of Classification Search ..... 417/390, 417/401, 378, 399, 400, 402, 498; 166/105, 166/370, 372, 373
See application file for complete search history.

(56) References Cited

U.S. PATENT DOCUMENTS

| | | | | |
|---|---|---|---|---|
| 1,730,336 | A | 10/1929 | Bellocq | |
| 1,730,337 | A | 10/1929 | Bellocq | |
| 1,941,593 | A | 1/1934 | Beliocq | |
| 2,075,428 | A | 3/1937 | Dickson | 417/383 |
| 2,123,139 | A | 7/1938 | Huff | 417/377 |
| 2,444,912 | A | 7/1948 | Bodine, Jr. | |
| 2,553,541 | A | 5/1951 | Bodine, Jr. | |
| 2,553,542 | A | 5/1951 | Bodine, Jr. | |
| 2,553,543 | A | 5/1951 | Bodine, Jr. | |
| 2,572,977 | A | 10/1951 | Bodine, Jr. | 103/43 |
| 2,953,095 | A | 9/1960 | Bodine | |
| 3,103,175 | A | 9/1963 | Humphrey | |
| 3,722,640 | A | 3/1973 | Taylor | 188/316 |
| 4,109,724 | A | 8/1978 | Barrington | |
| 4,109,725 | A | 8/1978 | Williamson | |
| 4,137,017 | A | 1/1979 | Lonardo | |
| 4,234,294 | A | 11/1980 | Jensen | |
| 4,295,799 | A | 10/1981 | Bentley | |
| 4,297,088 | A * | 10/1981 | Akkerman | 417/378 |
| 4,390,326 | A | 6/1983 | Callicoatte | |
| 4,490,095 | A * | 12/1984 | Soderberg | 417/46 |
| 4,616,981 | A * | 10/1986 | Simmons et al. | 417/378 |
| 4,664,196 | A | 5/1987 | Manke | |

(Continued)

FOREIGN PATENT DOCUMENTS

DE 19721814 A1 5/1997

(Continued)

OTHER PUBLICATIONS

"Feature Comparison: Engineered suspension solutions for your ride and handling issues!: Ride with Class"; 2004, *LiquidSpring LLC*, 2 pages.

(Continued)

*Primary Examiner* — Devon C Kramer
*Assistant Examiner* — Leonard J Weinstein
(74) *Attorney, Agent, or Firm* — Kilpatrick Townsend & Stockton LLP.; M. Henry Heines

(57) ABSTRACT

A pump has a pump barrel formed from a larger diameter section and a smaller diameter section. Each section has a biased piston moveable within the section and the pistons are connected together to form a variable volume chamber between the pistons. As the connected pistons move toward the larger diameter section, a volume of fluid is moved through an inlet valve into the variable volume chamber of increasing volume. When the pistons are moved toward the smaller diameter section, a differential volume of fluid is discharged from the variable volume chamber of decreasing volume through a discharge valve into a discharge conduit. The pistons are actuated to move within the pump barrel by application and release of pressure at a remote end of the discharge conduit.

33 Claims, 6 Drawing Sheets

U.S. PATENT DOCUMENTS

| | | | | |
|---|---|---|---|---|
| 4,665,991 | A | 5/1987 | Manke | |
| 4,880,363 | A * | 11/1989 | Holland | 417/390 |
| 5,209,303 | A | 5/1993 | Barrington | |
| 5,494,102 | A | 2/1996 | Schulte | |
| 6,015,010 | A | 1/2000 | Kostrov | |
| 6,193,476 | B1 | 2/2001 | Sweeney | |
| 6,364,633 | B1 | 4/2002 | Kelly | |
| 6,817,409 | B2 | 11/2004 | Howard | 166/108 |
| 7,246,662 | B2 | 7/2007 | Jabusch et al. | 166/250.2 |
| 2006/0045767 | A1 | 3/2006 | Liknes | |
| 2006/0045781 | A1 | 3/2006 | Liknes | |

FOREIGN PATENT DOCUMENTS

| | | | |
|---|---|---|---|
| DE | 19721814 | C2 | 5/1997 |
| GB | 438395 | | 5/1935 |
| GB | 1392089 | A | 4/1975 |

OTHER PUBLICATIONS

"Feature Comparison: Engineered suspension solutions for your ride and handling issues!: Move up with Class"; 2004, *LiquidSpring LLC*, 2 pages.

Office Action (Restriction Requirement) dated Jan. 25, 2010 for U.S. Appl. No. 11/852,052 (no references).

Office Action dated Jul. 21, 2010 for U.S. Appl. No. 11/852,052.

National Oilwell 8S-25 Simplex Plunger Pump Specifications, Houston, Texas, 1999 (2 pages).

Wheatley and Gaso Pumps webpage, Feb. 17, 2006, Specifications for P50 2-3/16" Stroke Simplex Plunger Pump, IEQ Industries Ltd., Ada, MI, USA (2 pages).

* cited by examiner

DISCHARGE PRESSURE ACTUATED PUMP

FIELD OF THE INVENTION

Embodiments of the invention are related to pumps and more particularly to single conduit pumps for use in locations remote from the pump's discharge including being located in wellbores, the pumps being actuated remotely such as by cycling pressure at the discharge of the pump.

BACKGROUND OF THE INVENTION

Pumps are well known to move fluids from at least a first location to a second location. A large number of pump configurations are known, each with particular advantages and disadvantages and which may have been designed for particular uses in a variety of fluid-moving industries.

It is well known to provide pumping apparatus situated in subterranean wellbores for pumping fluid therefrom to the surface. Conventionally, a prime mover, such as an electric motor, has been located at the pump or mechanically connected thereto so as to permit actuation of pumps, such as a rod pump or progressive cavity pump, to lift liquids such as produced fluids and accumulated fluids therefrom. In the case of wellbores, particularly those situated in remote locations, it is desirable to situate the pump within the wellbore and to actuate the pump remotely. Typically, many of the pumps known in the art require two conduits, one to provide a motive force to operate the pump, such as in the case of hydraulic-actuated pumps, and the second to permit production of the fluids to surface.

In the case of said wellbores, it is known to provide remotely actuated pumps, such as those which are actuated by sonic or acoustic pressure waves (U.S. Pat. No. 4,295,799 to Bentley, U.S. Pat. No. 1,730,336 to Bellocq, U.S. Pat. Nos. 2,444,912, 2,553,541, 2,553,542, 2,553,543, and 2,953,095, to Bodine Jr.)

Further it is known to provide remotely actuated pumps which are actuated by alternately applying and releasing pressure at discharge of the pump. One such pump is taught in U.S. Pat. No. 4,390,326 to Callicoate which teaches an annular external piston and an internal piston movable in concentric annular and internal chambers. The internal chamber has an inlet end and an outlet end fit with one-way valves. The internal piston divides an internal barrel into a lower chamber and an upper chamber. The lower chamber has an inlet valve and an outlet valve through which pumped fluid is transferred to the upper chamber. The upper chamber has an outlet valve through which fluids are transferred into conduit thereabove. As the pump is stroked, fluid from below the pump is sucked into the lower chamber on the upstroke. On the downstroke, the fluid in the lower chamber is transferred to the upper chamber through the valve positioned therebetween. On the next upstroke, while fluid is being drawn into the lower chamber, the fluid in the upper chamber is transferred from the space above, through the upper chamber's outlet valve, while the external piston causes the fluid in the space above to be pumped to surface. Pressure is applied cyclically to the conduit causing the pistons to be moved downhole. An energy storing means, such as a spring, returns the pistons uphole as the pressure is relieved at the conduit discharge.

Remotely actuated pumps are particularly advantageous for use in oil wells to produce hydrocarbons to surface and for deliquification of gas wells, wherein the pump can be situated at or near the perforations, and can be actuated to pump accumulated liquids such as water and condensate, to the surface which, if left to accumulate in the conduit through which the gas is produced causes backpressure on the formation which impedes gas flow and which may eventually kill gas production.

In the case of deliquification of gas wells, conventionally beam pumps or hydraulic pumps, including piston downhole pumps and jet pumps have been used, as have electric submersible pumps and progressive cavity pumps however the cost of these pumps is relatively high. Regardless the use, providing power for actuation of such pumps in remote locations, size of the pumps and interference due to produced gas during use in deliquification have typically been problematic.

Further, other technologies such as foam lift, gas lift and plunger lift have been used to deliquify gas wells. In some of the known technologies, the gas well must be shut-in for at least a period of time to permit sufficient energy to be built up to lift the accumulated fluids which results in, at best, a cyclic production of gas from the wellbore.

Clearly, there is interest in a large variety of fluid-moving industries for technologies, including pumping apparatus, which have relatively low power requirements, are capable of being remotely actuated and which have a relatively high pumping efficiency. Of particular interest are pump apparatus for use in producing fluids from wellbores, including but not limited to deliquifying of gas wells to improve and maintain production therefrom.

SUMMARY OF THE INVENTION

Generally, a fluid apparatus for moving fluid from a fluid source to a discharge incrementally pumps a differential volume of fluid due to a chamber having a variable volume formed between two connected pistons which are moveable axially within a pump barrel of stepped diameter.

In a broad aspect of the invention, a fluid apparatus comprises: a pump barrel having a first barrel section in fluid communication with a fluid source and a second barrel section in fluid communication with a discharge conduit, the first barrel section having a diameter greater than the second barrel section, the first and second barrel sections being fluidly connected therebetween; a first piston housed in the first barrel section for axial movement therein; a second piston housed in the second barrel section for axial movement therein; means connecting between the first and second pistons for concurrent axial movement within the pump barrel between an inlet position and a discharge position, the first and second pistons being spaced apart for forming a chamber of variable volume therebetween; biasing means for biasing the first and second pistons to the discharge position; an inlet check valve to permit fluid to move from the fluid source to the variable volume chamber; and an outlet check valve to permit fluid to move from the variable volume chamber to the discharge conduit, wherein when an actuating pressure sufficient to overcome the biasing means is applied to the second piston through the discharge conduit, the outlet valve closes and the first and second pistons move to the inlet position and increase the variable volume chamber by a differential volume, opening the inlet valve and permitting the flow of the differential volume of fluid from the fluid source through the inlet valve into the variable volume chamber; and when the actuating pressure is released, the biasing means returns the first and second pistons to the discharge position for displacing the differential volume of fluid from the variable volume chamber, closing the inlet valve and opening the outlet valve for discharging the differential volume of fluid through the outlet valve to the discharge conduit.

In embodiments of the invention, the biasing means can be housed within the variable volume chamber or in the pump barrel below the first piston and is connected between the pump barrel and one of either the first or second piston.

The inlet and discharge valves are positioned at an inlet end and a discharge end, respectively, of the pump pistons or alternately at an inlet and discharge end of a bypass passageway fluidly connected to the variable volume chamber.

Embodiments of the invention are used to move fluid from a source location to a discharge location and may be particularly advantageous for remote actuation in wellbores for deliquifying wellbores having an accumulation of liquid therein which reduces or potentially stops wellbore production.

Therefore in another broad aspect of the invention, a method for producing accumulated liquids from a gas well comprises: positioning a fluid apparatus in the wellbore and forming an annulus therebetween, the apparatus having a pump barrel having a first barrel section in fluid communication with a fluid source and a second barrel section in fluid communication with a discharge conduit, the first barrel section having a diameter greater than the second barrel section, the first and second barrel sections being fluidly connected therebetween; a first piston housed in the first barrel section for axial movement therein; a second piston housed in the second barrel section for axial movement therein; means connecting between the first and second pistons for concurrent axial movement within the pump barrel between an inlet position and a discharge position, the first and second pistons being spaced apart for forming a chamber of variable volume therebetween; biasing means for biasing the first and second pistons to the discharge position; an inlet check valve to permit fluid to move from the fluid source to the variable volume chamber; and an outlet check valve to permit fluid to move from the variable volume chamber to the discharge conduit, wherein when an actuating pressure sufficient to overcome the biasing means is applied to the second piston through the discharge conduit, the outlet valve closes and the first and second pistons move to the inlet position and increase the variable volume chamber by a differential volume, opening the inlet valve and permitting the flow of the differential volume of fluid from the fluid source through the inlet valve into the variable volume chamber; and when the actuating pressure is released, the biasing means returns the first and second pistons to the discharge position for displacing the differential volume of fluid from the variable volume chamber, closing the inlet valve and opening the outlet valve for discharging the differential volume of fluid through the outlet valve to the discharge conduit; producing gas to surface through the annulus, liquid accumulating in the wellbore adjacent the distal end of the conduit; cyclically applying an actuating pressure at the discharge conduit such that when the force of the actuating pressure is greater than the force exerted by the biasing means and a force of pressure at the fluid source, the discharge valve operates to the closed position, the first and second pistons move to the inlet position and the inlet valve operates to the open position for charging the accumulated fluids from the wellbore into the variable volume chamber; and releasing the actuating pressure so that the first and second pistons are urged to return to the discharge position, the inlet valve moving to the closed position, the discharge valve moving to the open position and pumping the differential volume from the variable volume chamber through the discharge valve to the discharge conduit.

BRIEF DESCRIPTION OF THE DRAWINGS

FIG. 1A illustrates an idle position wherein an outlet valve and an inlet valve are in a closed position;

FIG. 1B illustrates the first position wherein the first and second pistons are moved causing the inlet valve to open and a variable volume chamber between the first and second pistons to be charged with fluid; and FIG. 1C illustrates a second position wherein the first and second pistons are moved causing the outlet valve to be be opened, the fluid being displaced from the variable volume chamber, pumping a differential volume created by the variable volume chamber into the conduit above the pump barrel;

FIG. 2A illustrates an idle position wherein an outlet valve and an inlet valve are in a closed position;

FIG. 2B illustrates the first position wherein the first and second pistons are moved causing the inlet valve to open and a variable volume chamber between the first and second pistons to be charged with fluid; and FIG. 2C illustrates a second position wherein the first and second pistons are moved causing the outlet valve to be opened, the fluid being displaced from the variable volume chamber, pumping a differential volume created by the variable volume chamber into the conduit above the pump barrel;

FIG. 3A illustrates an idle position wherein an outlet valve and an inlet valve are in a closed position;

FIG. 3B illustrates the first position wherein the first and second pistons are moved causing the inlet valve to open and a variable volume chamber between the first and second pistons to be charged with fluid; and FIG. 3C illustrates a second position wherein the first and second pistons are moved causing the outlet valve to be opened, the fluid being displaced from the variable volume chamber, pumping a differential volume created by the variable volume chamber into the conduit above the pump barrel;

DETAILED DESCRIPTION OF THE PREFERRED EMBODIMENT

Figures 1A, 1B, 1C:
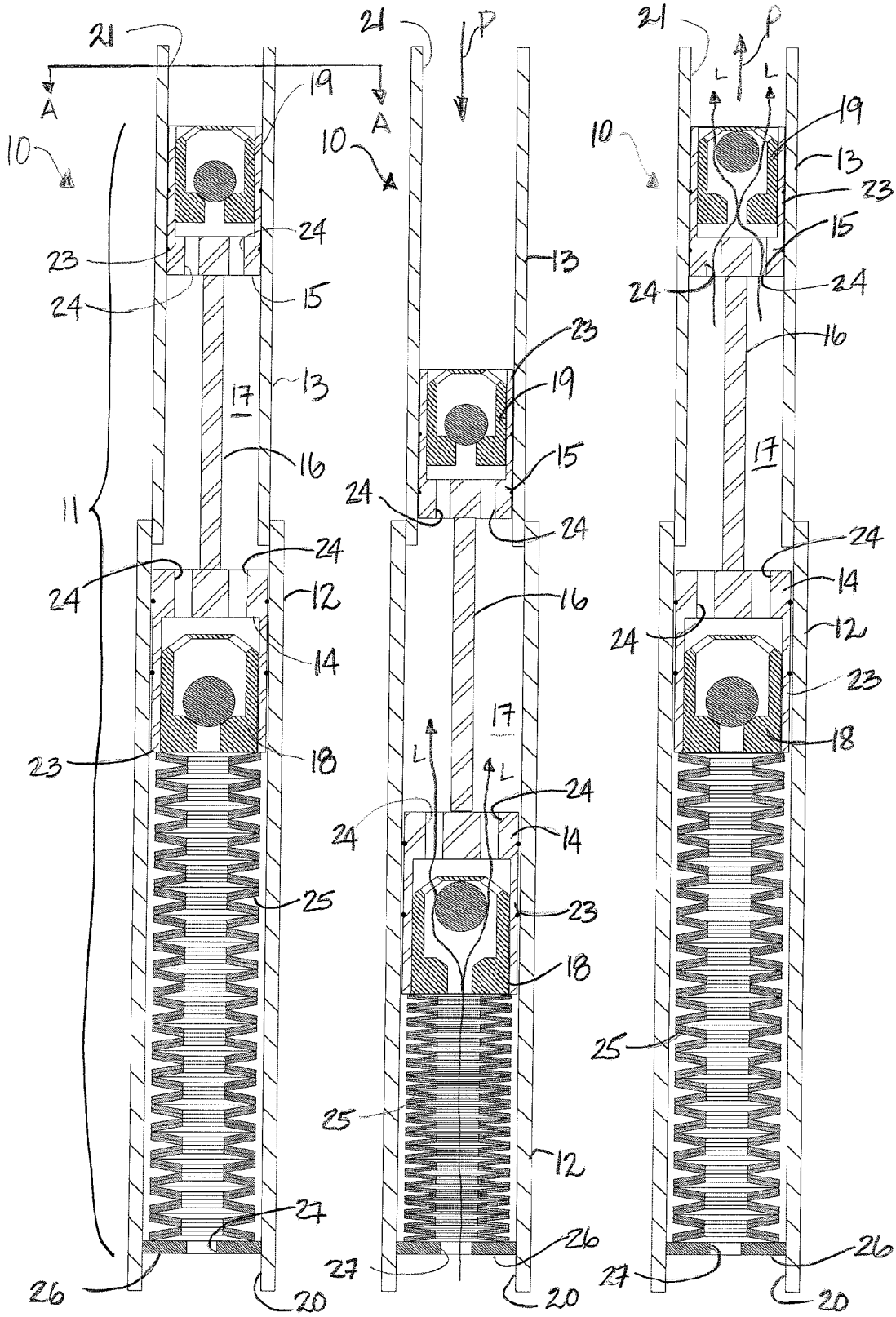
FIGS. 1A-1C are partial longitudinal sectional views of a pump according to an embodiment of the invention, first and second pistons positioned in a pump barrel connected to a single conduit and biasing means for storing energy to return the pistons located below the first piston, more particularly.
Figure 1D:
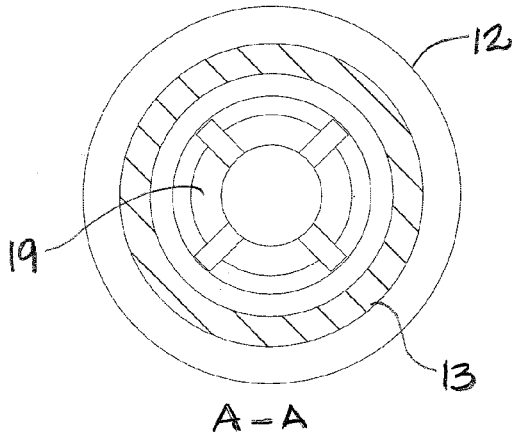
FIG. 1D is a cross sectional view along section A-A, according to FIG. 1A.
Figure 3D:
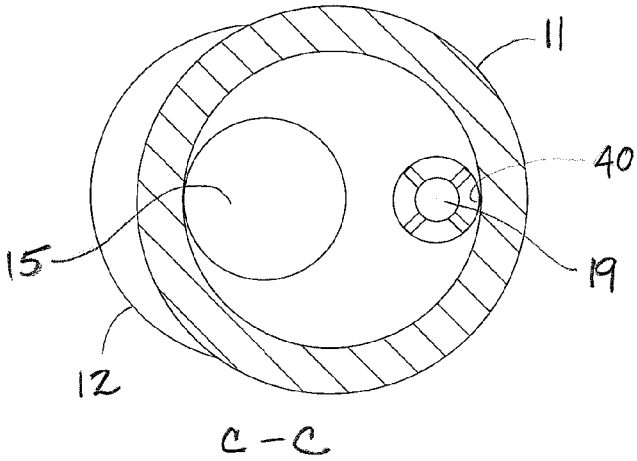
FIG. 3D is a cross sectional view along section C-C, according to FIG. 3A.

Embodiments of the invention are disclosed herein in the context of a fluid device, or pump, particularly useful in the production of fluids through a single discharge conduit extending from surface to a subterranean zone of interest. Description in this context is in no way intended to limit the scope of the invention to fluid devices for use in a subterranean wellbore, the device being equally applicable for remotely actuating and pumping fluids from any fluid source to a discharge in a variety of contexts, including from a sump, lake or pipeline.

Having reference to FIGS. 1A-1D, 2A-2D, 3A-3D, 4A, 4B and 5 and in a wellbore context, a subterranean zone of interest or fluid source F (FIG. 5) is located remote from the surface where the fluid, such as a liquid, is to be produced. A discharge conduit 1 having a liquid discharge end 2 at surface 3 extends downhole to an inlet end 4 in fluid communication with the fluid source F. A fluid apparatus or pump 10, according to an embodiment of the invention, is fluidly connected at the inlet end 4 for pumping liquid from the fluid source F to surface 3 as a result of an actuating pressure P being applied to the discharge conduit 1, typically at surface 3.

Having reference to FIGS. 1A-1D and 2A-2D, the pump 10 comprises a pump barrel 11 having a first barrel section 12 and a second barrel section 13 the first and second sections 12,13 being fluidly connected therebetween. The first barrel section 12 is in fluid communication with the fluid source F and the second barrel section 13 is in fluid communication with the discharge conduit 1. A diameter of the first barrel section 12 is greater than the diameter of the second barrel section 13. A pump piston comprises a first piston 14 housed within the first barrel section 12 for axial movement therein, and a second piston 15 housed within the second barrel section 13 for axial movement therein. The first and second pistons 14,15 are connected therebetween and spaced apart by a connector such as a rod 16, forming a variable volume chamber 17 therebetween which changes volume as the pistons 14,15 are actuated to concurrently move axially within the barrel sections 12,13. As the pistons 14,15 move towards the first barrel section 12, the variable volume chamber 17 increases in volume and as the pistons 14,15 move towards the second barrel section 13, the variable volume chamber 17 decreases in volume.

More particularly, a differential volume is created when the connected pistons 14,15 are actuated to move toward the first larger diameter barrel section 12 which permits a larger volume of fluid to enter the variable volume chamber 17 than the chamber 17 will contain when the connected pistons 14,15 are subsequently actuated to move toward the second smaller diameter barrel section 13. Reciprocating movement or stroking of the pump pistons 14,15 in the pump barrel 11 creates the differential volume which is forcibly discharged from the variable volume chamber 17 to the discharge conduit 1 on each pump stroke.

More specifically, an inlet one way or check valve 18 is positioned at an inlet end 20 of the pump barrel 11 to permit the flow of fluid from the fluid source F into the variable volume chamber 17. A discharge one way or check valve 19 is positioned at a discharge end 21 of the pump barrel 11 to permit the flow of fluid from the variable volume chamber 17 to the discharge conduit 1.

Having reference again to FIGS. 1A-1D and 2A-2D and in one embodiment, the inlet check valve 18 is located in the first piston 14, and the discharge check valve 19 is located in the second piston. In one embodiment, the inlet check valve 18 and the discharge check valve 19 are ball valves.

In use, to actuate the pump 10, pressure is cyclically exerted at a discharge end 22 of the discharge conduit 1. The connected first and second pistons 14,15 are actuated to move from an idle position (FIG. 1A) to a first inlet position (FIG. 1B) wherein the first and second pistons 14,15 are moved toward the inlet end 20 of the pump barrel 11, typically a downhole movement in the context of a wellbore pump. To complete the pumping cycle, the first and second pistons 14,15 move to a second discharge position (FIG. 1C), returning to the discharge end 21 of the pump barrel 11.

In the idle and discharge positions, fluid pressure at the inlet check valve 18 causes the inlet check valve 18 to close. As the first and second pistons 14,15 are moved to the first inlet position, the volume in the variable volume chamber 17 becomes larger. The inlet check valve 18 opens to permit fluid L from the fluid source F adjacent the inlet end 20 of the pump barrel 11 to be sucked into the variable volume chamber 17 through the inlet check valve 18.

Optionally, the inlet and discharge valves 18,19 can form the pistons 14,15 which sealably engage the barrel 11 or the inlet and discharge valves 18,19 can be supported in a piston housing. As shown, each pistons 14,15 comprises a cylindrical housing 23 having ports 24 formed therein for conducting fluids from the inlet and discharge check valves 18,19 through the pistons 14,15.

Biasing means 25 acting between the pump pistons 14,15 and pump barrel 11 to store energy as the first and second pistons 14,15 are moved downhole to the inlet position. Preferably, the biasing means 25 is a spring, pressurized bellows, elastomeric element or the like. As shown, the spring 25 can be a spring washer, such as a Belleville spring (FIGS. 1A-4A), or, as schematically represented in FIG. 4B, a coil spring or the like.

Thus, when the force of the actuating pressure P applied to the discharge conduit 1 and acting at the second piston 15 exceeds the combined force of the pressure at a fluid source F and the spring 25 biasing, the pistons 14,15 are caused to move to the inlet position, typically downhole in the context of a wellbore. Release of the actuating pressure P permits the spring 25 to release stored energy and causes the pistons 14,15 to move to the discharge position, typically uphole in the context of a wellbore.

As the pistons 14,15 are caused to move to the discharge position, the volume of the variable volume chamber 17 becomes smaller resulting in a differential volume, being the difference in volume of the variable volume chamber between the inlet and discharge positions. The inlet check valve 18 is caused to close and as the volume of the variable volume chamber 17 becomes smaller, the discharge check valve 19 is opened and the differential volume is discharged into the discharge conduit 1. Cyclically repeating the application and the release of pressure P at the discharge end 22 of the discharge conduit 1, results in fluids being pumped from the fluid source F, through the pump 10 and into the discharge conduit 1 for eventual transport to a discharge 2, such as at surface 3.

In an embodiment of the invention a hydraulic circuit (not shown) may be used to apply actuating pressure P at the discharge end 22. Alternately, actuating pressure P may be applied using a positive displacement pump, such as a plunger pump (not shown).

In one embodiment of the invention shown in FIGS. 1A-1C, the biasing means 25 is housed in the pump barrel 11 between the first piston 14 and a stop 26 formed adjacent the inlet end 21 of the pump barrel 11. An inlet port 27 is formed in the stop 26 to permit fluid L from the fluid source F to enter the pump 10. As the pistons 14,15 are moved to the inlet position, the biasing means 25 is compressed by the pistons 14,15 against the stop 26, thereby storing energy in the biasing means 25. When the actuating pressure P is released at the discharge end 22 of the discharge conduit 1, the biasing means 25 acts between the stop 26 and the pistons 14, 15 to move the pistons 14,15 to the discharge position. Preferably, the biasing means is a spring 25.

Figure 2D:
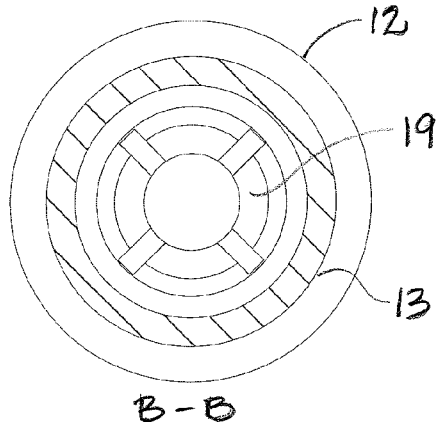
FIG. 2D is a cross sectional view along section B-B, according to FIG. 2A.
Figures 2A, 2B, 2C:
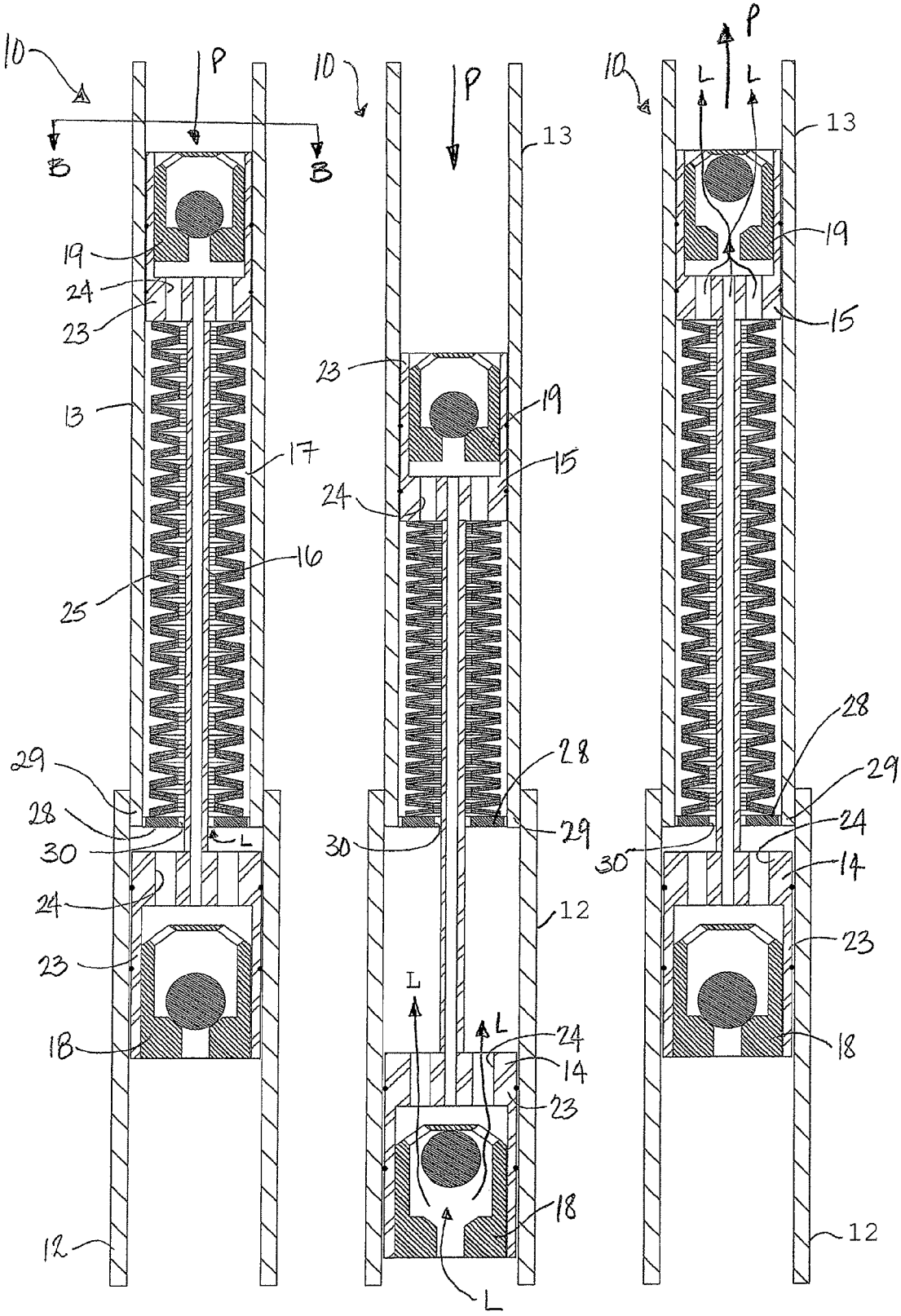
FIGS. 2A-2C are partial longitudinal sectional views of a pump according to one embodiment of the invention, the biasing means being positioned between the first and second piston in the variable volume chamber, more particularly.

In one embodiment as shown in FIGS. 2A-2C, the biasing means 25 is positioned in the variable volume chamber 17 between the second piston 15 and a stop 28 formed adjacent a lower end 29 of the second barrel section 13. One or more ports 30 are formed in the stop 28 to permit passage of the rod 16 and for the flow of fluids L therethrough between the first and second pump sections 12,13. Further, the rod 16 is hollow to aid in moving fluids from the inlet valve 18 to the discharge valve 19.

In one embodiment shown in FIGS. 3A-3D, the pump barrel 11 further comprises a bypass passageway 40 for forming a second chamber 41 which is fluidly connected to the variable volume chamber 17. The inlet valve 18 is positioned at an inlet end 42 of the second chamber 41 in fluid communication with the fluid source F. The discharge valve 19 is positioned at a discharge end 43 of the second chamber 41 in fluid communication with the discharge conduit 1. A port 44 is formed between the variable volume chamber 17 and the second chamber 41 and between the first and second pistons 14,15. As actuating pressure P is applied at the discharge end 22 of the discharge conduit 1 and the discharge valve is in the closed position, the pistons 14, 15 are caused to move to the inlet position and the inlet valve 18 is opened for admitting fluid L to the second chamber 41 and through port 44 to the variable volume chamber 17. As the actuating pressure P is released at the discharge end 22 of the discharge conduit 1, the inlet valve 18 is caused to close, the pistons 14,15 are biased to the discharge position by the biasing means 25 and the discharge valve 19 opens for discharging the differential volume of fluid from the second chamber 41 into the discharge conduit 1. Ports 24 are not required in the pistons 14,15 in this embodiment as fluid flow is directed through port 44.

The biasing means 25, like the previous embodiments, may be housed in the same manner in the variable volume chamber 17 or in the pump barrel 11 below the first piston 14.

Actuation of the pump 10 is accomplished remotely through the application and release of pressure at the discharge 21 and therefore a prime mover is not required to be situated at or near the pump in the wellbore. Further, where a plurality of wells are situated in close proximity, the plurality of wells could be connected hydraulically to a single source of cyclic pressure for operating the plurality of wells.

Where the fluid source F is positioned substantially vertical and up to about a 60 degree inclination relative to the discharge 21, ball and seat valves are suitable for use as the inlet and discharge check valves 18,19. However, where the fluid source F is positioned substantially horizontal to the discharge 21, such as in a horizontal pipeline, spring loaded check valves may be more suitable for use as the inlet and discharge valves 18,19.

Figure 5:
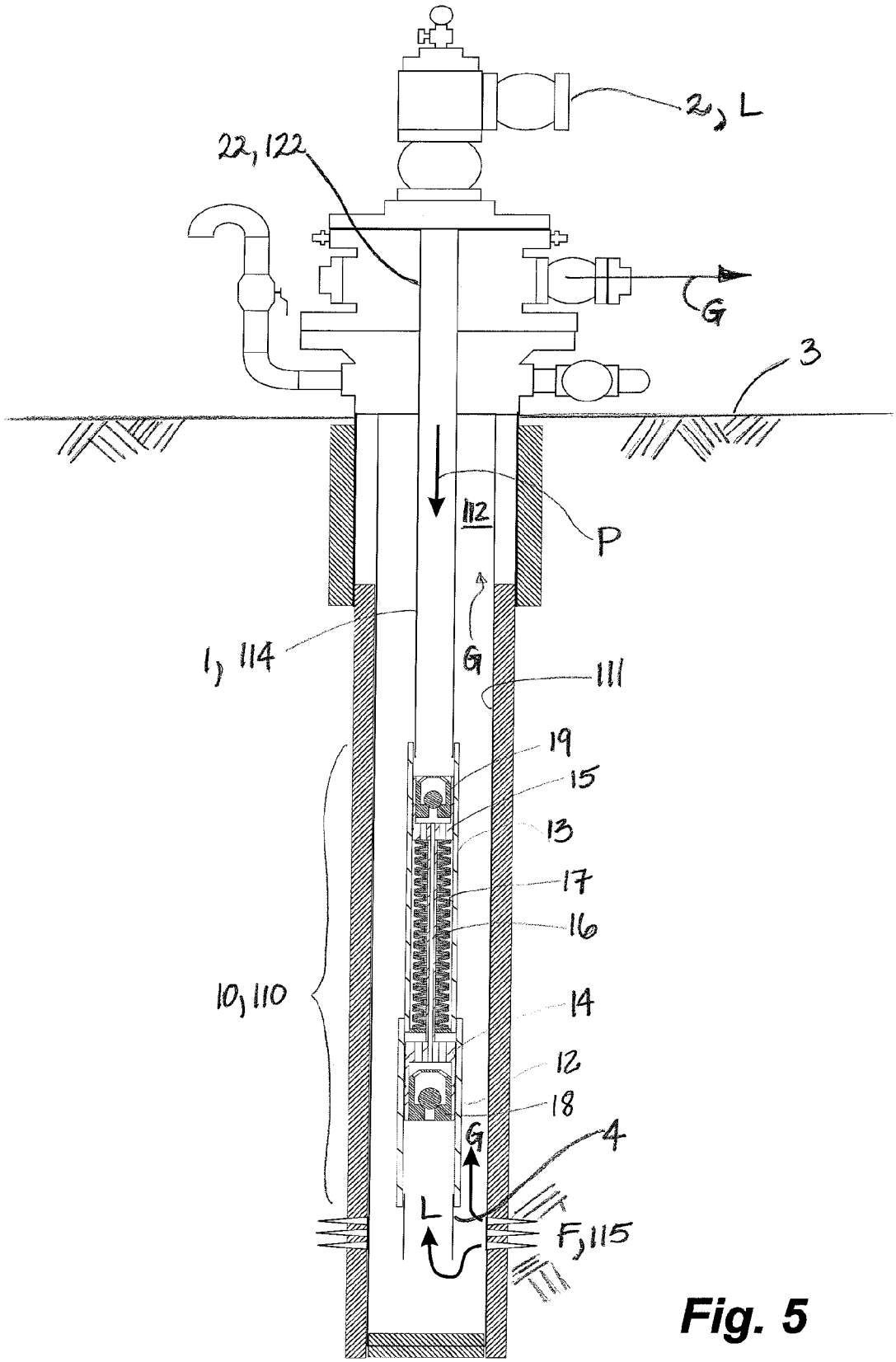
FIG. 5 is a partial longitudinal sectional view of a pump according to FIGS. 1*a*-1*c* positioned in a wellbore, the pump having a single conduit extending to surface for producing accumulated liquids from the wellbore, gas being produced to surface in an annulus between the conduit and the wellbore.

One particular use as shown in FIG. 5, wherein embodiments of the invention are particularly well suited, is the deliquification of gas wells. A distal end of a single conduit, such as a tubing string 114, is fit with a pump 110 according to an embodiment of the invention. The pump 110 is lowered into a wellbore 111 of a gas well and forms an annulus 112 between the conduit 114 and the wellbore 111. The discharge end 122 of the conduit 114 is positioned at surface 3. The pump 110 is positioned adjacent a zone of interest 115 where liquid L co-produced from the gas-producing formation accumulate and, which if left in the wellbore 111, would eventually hinder or stop gas production. Gas G is typically produced through the annulus 112 from the zone of interest 115 to surface 3. Actuation pressure P is cyclically applied and released at the discharge end 122 of the conduit 114 such as through a hydraulic circuit or a positive displacement pump. The actuation pressure P acts at piston 15 of the pump 110. The pump 110 is actuated, as discussed herein, to produce accumulated liquids L to surface 3 through the conduit 114 thereby reducing any hydrostatic head caused by the accumulation of the liquids L in the wellbore 111 and permitting production of the gas G through the annulus 112.

Actuation of the pump 110 can be continuous or intermittent. If operated continuously, the pump 110 removes even small accumulations of liquid L. Alternatively, the pump 110 can be operated intermittently on a fixed (similar to continuous) or a dynamically controlled periodic basis. Typically, a controller would activate the pump 110 either at regular predetermined intervals based on historical liquid accumulation for a particular reservoir type, or dynamically in response to a remote sensor which is able to sense a predetermined volume of fluid accumulation. In either case, actuation of the pump 110 would typically require very low power, such as can be provided by such as by a natural gas powered engine in remote locations not accessible to a utility grid or using an electric motor where electricity is available. Further, an accumulator on a hydraulic circuit or a flywheel on a plunger pump drive may be used to conserve energy.

EXAMPLES

A variety of configurations of embodiments of the pump 110 disclosed herein have been modeled for use in wellbore casings of different diameter. The various configurations are shown in Table A.

TABLE A

| | Units | 1 | 2 | 3 | 4 | 5 |
|---|---|---|---|---|---|---|
| Outlet barrel bore API | inches | 1.5 | 2.25 | 1.5 | 2.25 | 1.5 |
| Inlet barrel bore API | inches | 2.25 | 2.75 | 2.75 | 3.25 | 3.25 |
| Outlet barrel bore, metric | mm | 38.1 | 57.15 | 38.1 | 57.15 | 38.1 |
| Inlet barrel bore, metric | mm | 57.15 | 69.85 | 69.85 | 82.55 | 82.55 |
| Outlet barrel x-section area | $mm^2$ | 1140 | 2564 | 1140 | 2564 | 1140 |
| Inlet barrel x-section area | $mm^2$ | 2564 | 3830 | 3830 | 5349 | 5349 |
| Ratio of inlet to outlet areas | | 2.250 | 1.494 | 3.361 | 2.086 | 4.694 |
| Depth of pump | m | 500 | 500 | 500 | 500 | 500 |
| Static head on pump w. water column | Bar | 50 | 50 | 50 | 50 | 50 |
| Static force on outlet piston | N | 5695 | 12814 | 5695 | 12814 | 5695 |
| Pressure applied at surface (target ~3x static at pump) | Bar | 80 | 90 | 130 | 150 | 100 |
| Additional force on outlet piston | N | 9112 | 23066 | 14808 | 38443 | 11391 |
| Total force on outlet piston | N | 14808 | 35880 | 20503 | 51258 | 17086 |
| Ratio static to pressurized P at pump | | 2.60 | 2.80 | 3.60 | 4.00 | 3.00 |
| Belleville spring # | | D5025425 | D633135 | D63313 | D80364 | D80363 |

TABLE A-continued

| | Units | 1 | 2 | 3 | 4 | 5 |
|---|---|---|---|---|---|---|
| Height | mm | 3.9 | 4.9 | 4.8 | 6.2 | 5.7 |
| Thickness | mm | 2.5 | 3.5 | 3 | 4 | 3 |
| Cone height (H – t) | mm | 1.4 | 1.4 | 1.8 | 2.2 | 2.7 |
| # disks per stack | | 2 | 3 | 2 | 3 | 2 |
| Height of one disk stack | mm | 6.4 | 11.9 | 7.8 | 14.2 | 8.7 |
| 75% force, one stack | N | 9063 | 15025 | 12356 | 21400 | 11919 |
| 75% force, stacked disks (max deflection) | N | 18126 | 45075 | 25072 | 64200 | 23838 |
| 75% deflection, one disk stack | mm | 1.05 | 1.05 | 1.35 | 1.65 | 2.025 |
| Static (initial) deflection One disk stack | mm | 0.330 | 0.299 | 0.307 | 0.329 | 0.484 |
| Ratio, initial to 75% deflection | | 0.314 | 0.284 | 0.227 | 0.200 | 0.239 |
| Total deflection with applied pressure | mm | 0.858 | 0.836 | 1.104 | 1.317 | 1.451 |
| Ratio, operating to 75% deflection (target 80%) | | 0.82 | 0.80 | 0.82 | 0.80 | 0.72 |
| Effective stroke one disk stack | mm | 0.528 | 0.537 | 0.797 | 0.988 | 0.968 |
| Target stroke length | mm | 500 | 500 | 750 | 500 | 750 |
| Volume of fluid pumped per stroke | $mm^3$ | 712196 | 633063 | 2017889 | 1392739 | 3157403 |
| Volume of fluid pumped per stroke | bbls/d | 0.712 | 0.633 | 2.018 | 1.393 | 3.157 |
| Cycles per minute | | 6.0 | 6.0 | 6.0 | 6.0 | 6.0 |
| Volume of fluid pumped per day | $m^3/d$ | 6.2 | 5.5 | 17.4 | 12.0 | 27.3 |
| Volume of fluid pumped per day | bbls/d | 38.8 | 34.5 | 109.8 | 75.8 | 171.9 |
| # disk pairs to achieve target stroke length | | 947 | 931 | 941 | 506 | 775 |
| Total # disks | | 1894 | 2793 | 1882 | 1518 | 1550 |
| Total disk height | mm | 6062 | 11074 | 7337 | 7186 | 6743 |

As discussed above, the volume of the variable volume chamber 17 is greater when the pistons 14,15 are in the inlet position than when the pistons 14, 15 are in the discharge position. Various arrangements can result in this characteristic including the embodiments of FIGS. 1A-3D wherein the first piston 14 and first barrel section 12 have a larger diameter than the second piston 15 and second barrel section 13. A connecting rod 16 fixes the spacing of the first and second pistons 14,15. An advantage includes maximizing the barrel diameter for inserting into a wellbore or other annular constraint at the fluid source F.

Another example of an arrangement causing a differential swept volume includes replacing the fixed connecting rod 16 with an axial movement multiplier between the first and second pistons 14,15 such that the axial movement of the first piston is augmented relative to the second piston. A simple mechanical lever with an offset fulcrum would suffice.

Figures 3A, 3B, 3C:
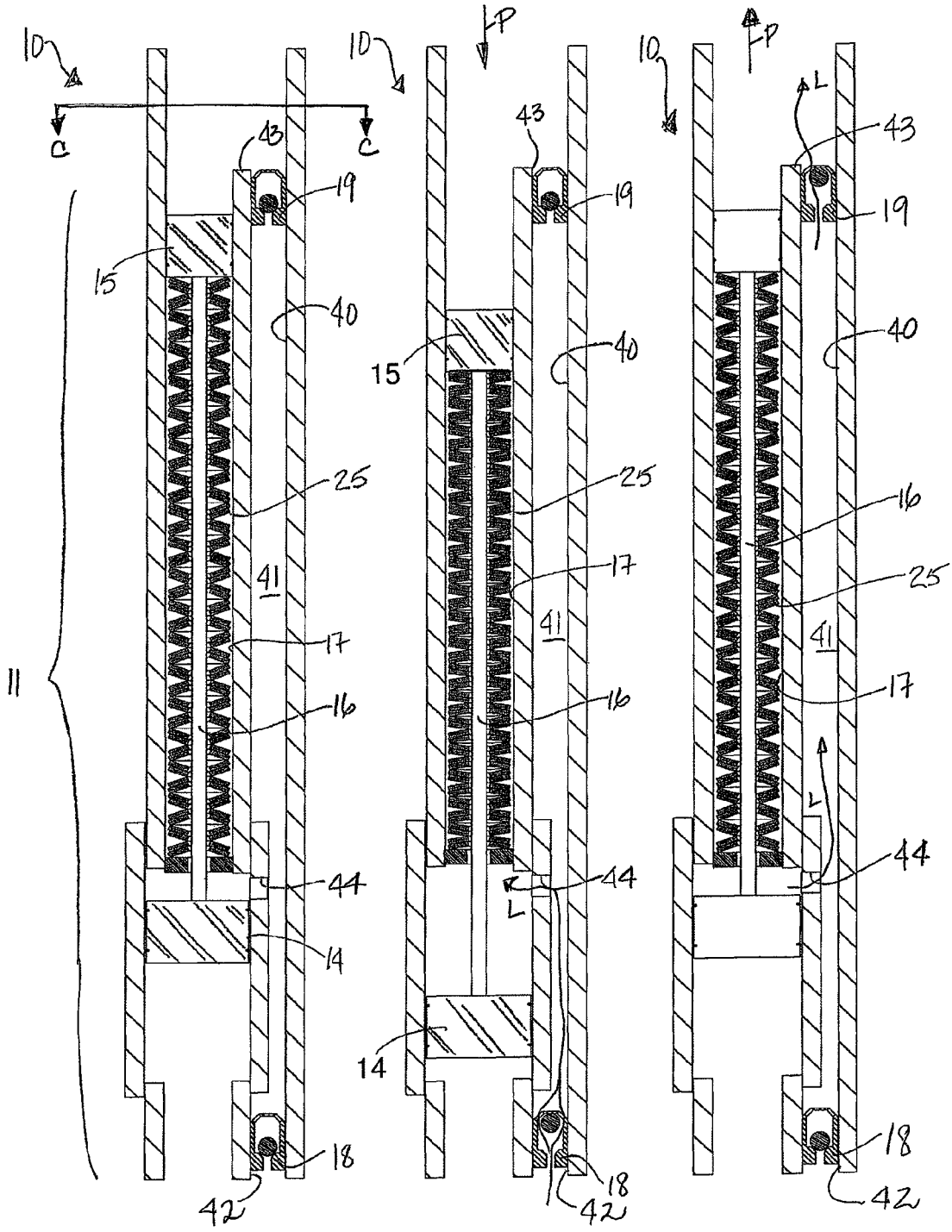
FIGS. 3A-3C are partial longitudinal sectional views of a pump according to one embodiment of the invention, the biasing means being positioned in the variable volume chamber, the inlet valve and outlet valve being housed in a third chamber fluidly connected to the variable volume chamber, more particularly.
Figure 4A:
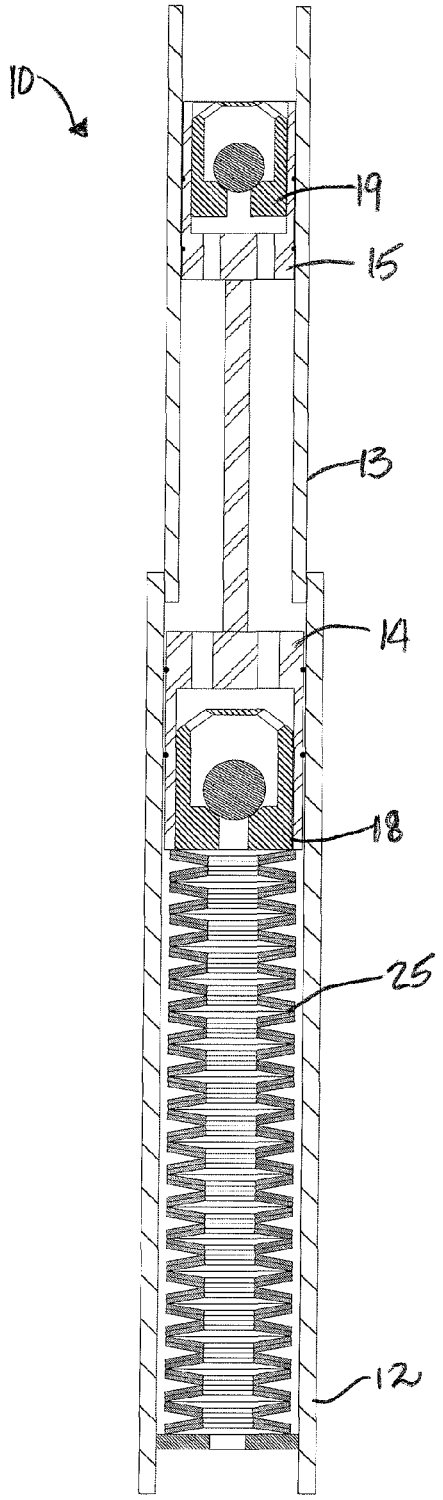
FIG. 4A is a partial longitudinal sectional view of a pump according to FIG. 1A, the biasing means being a Belleville spring.
Figure 4B:
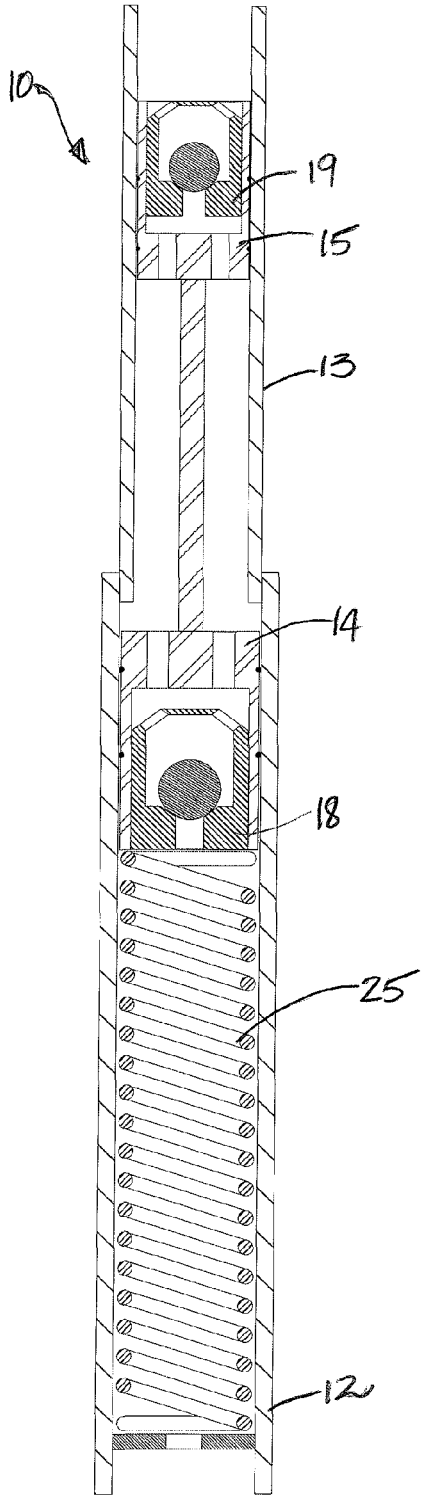
FIG. 4B is a partial longitudinal sectional view of a pump according to FIG. 1A, the biasing means being a coil spring.

Further, the inlet and discharge valves 18,19 can be integrated with the pistons 14,15, as shown in FIGS. 1A-2C or as shown in FIGS. 3A-3C, one or both can be located in a second chamber 41 positioned along a sidewall of the pump barrel 11 and fluidly connected thereto through port 44 between the first and second pistons 14,15 to the variable volume chamber 17 therebetween.

The embodiments of the invention in which an exclusive property or privilege is claimed are defined as follows:

1. A fluid apparatus comprising:

a pump barrel having a first barrel section in fluid communication with a fluid source and a second barrel section in fluid communication with a discharge conduit;

a first piston housed in the first barrel section for axial movement therein;

a second piston housed in the second barrel section for axial movement therein in response to application of an actuating pressure to the discharge conduit, the first and second pistons defining a variable volume chamber between the first and second pistons;

a biasing element coupled to at least one of the first and second pistons;

an inlet check valve operable to permit fluid to flow from the fluid source into the variable volume chamber;

an outlet check valve operable to permit fluid to flow from the variable volume chamber into the discharge conduit;

a bypass passageway having an inlet end in fluid communication with the fluid source and an outlet end in fluid communication with the discharge conduit, the bypass passageway being in fluid communication with the variable volume chamber, and wherein the inlet check valve is disposed at the inlet end of the bypass passageway and operable to permit fluid to flow through the bypass passageway into the variable volume chamber and the outlet check valve is positioned at the outlet end of the bypass passageway and operable to permit fluid to be discharged from the variable volume chamber through the bypass passageway; and means for connecting the first and second pistons to cause movement of the first piston in response to movement of the second piston caused by the actuating pressure, the respective movements of the first and second pistons being operable to increase the volume of the variable volume chamber thereby drawing fluid into the variable volume chamber through the inlet check valve while causing energy to be stored in the biasing element, the stored energy in the biasing element being subsequently operable to cause respective return movement of the first and second pistons when the actuating pressure is decreased, the respective return movement of the first and second pistons being operable to reduce the volume of the variable volume chamber thereby causing fluid to be discharged from the variable volume chamber through the outlet check valve.

2. The fluid apparatus of claim 1 wherein the inlet check valve is not disposed in the first piston and the outlet check valve is not positioned in the second piston.

3. The fluid apparatus of claim 1 wherein the means for connecting comprises a rod.

4. The fluid apparatus of claim 1 wherein the fluid source is a zone of interest in a wellbore; and wherein an inlet position is downhole and a discharge position is uphole.

5. The fluid apparatus of claim 1 wherein the biasing element comprises a spring.

6. The fluid apparatus of claim 1 wherein the biasing element is disposed within the first barrel section.

7. The fluid apparatus of claim 1 wherein the biasing element is disposed within the second barrel section.

8. The fluid apparatus of claim 1 wherein the biasing element is connected between the pump barrel and at least one of the first and second pistons.

9. The fluid apparatus of claim 1 wherein the bypass passageway is in fluid communication with the variable volume chamber through a port.

10. The apparatus of claim 1 wherein the means for connecting is operably configured to cause the first and second pistons to have corresponding motions within the pump barrel and wherein the first barrel section has a first diameter and the second barrel section has a second diameter, the first diameter being greater than the second diameter to cause the volume of the variable volume chamber to increase in response to the application the actuating pressure, and to subsequently decrease when the actuating pressure is reduced.

11. The apparatus of claim 1 wherein the first and second pistons are operably configured for coordinated axial movement comprising:

axial movement in a first direction whereby the first piston moves away from the second barrel section while the second piston moves towards the first barrel section in response to the actuating pressure; and axial movement in a second direction, opposite to the first direction of axial movement, whereby the first piston moves toward the second barrel section while the second piston moves away from the first barrel section when the actuating pressure is decreased.

12. A fluid apparatus comprising:

a pump barrel having a first barrel section in fluid communication with a fluid source and a second barrel section in fluid communication with a discharge conduit;

a first piston housed in the first barrel section for axial movement therein;

a second piston housed in the second barrel section for axial movement therein in response to application of an actuating pressure to the discharge conduit, the first and second pistons defining a variable volume chamber between the first and second pistons;

a biasing element coupled to at least one of the first and second pistons;

an inlet check valve operable to permit fluid to flow from the fluid source into the variable volume chamber;

an outlet check valve operable to permit fluid to flow from the variable volume chamber into the discharge conduit;

a bypass passageway having an inlet end in fluid communication with the fluid source and an outlet end in fluid communication with the discharge conduit, the bypass passageway being in fluid communication with the variable volume chamber, wherein the inlet check valve is disposed at the inlet end of the bypass passageway and is operable to permit fluid to flow through the bypass passageway into the variable volume chamber and the outlet check valve is positioned at the outlet end of the bypass passageway and is operable to permit fluid to be discharged from the variable volume chamber through the bypass passageway; and a connector between the first and second pistons, the connector being operably configured to cause movement of the first piston in response to movement of the second piston caused by the actuating pressure, the respective movements of the first and second pistons being operable to increase the volume of the variable volume chamber thereby drawing fluid into the variable volume chamber through the inlet check valve while causing energy to be stored in the biasing element, the stored energy in the biasing element being subsequently operable to cause respective return movement of the first and second pistons when the actuating pressure is decreased, the respective return movement of the first and second pistons being operable to reduce the volume of the variable volume chamber thereby causing fluid to be discharged from the variable volume chamber through the outlet check valve.

13. The fluid apparatus of claim 12 wherein the inlet check valve is not disposed in the first piston and the outlet check valve is not disposed in the second piston.

14. The fluid apparatus of claim 12 wherein the connector comprises a rod.

15. The fluid apparatus of claim 12 wherein the fluid source is a zone of interest in a wellbore; and wherein an inlet position is downhole and a discharge position is uphole.

16. The fluid apparatus of claim 12 wherein the biasing element comprises a spring.

17. The apparatus of claim 12 wherein the connector is operably configured to cause the first and second pistons to have corresponding motions within the pump barrel and wherein the first barrel section has a first diameter and the second barrel section has a second diameter, the first diameter being greater than the second diameter to cause the volume of the variable volume chamber to increase in response to the application of the actuating pressure, and to subsequently decrease when the actuating pressure is reduced.

18. The apparatus of claim 12 wherein the connector is operably configured to cause a greater axial motion of the first piston than the axial motion of the second piston caused by the actuating pressure, the respective motions of the first and second pistons being operable to cause increasing and decreasing separation between the first and second pistons within the barrel thereby respectively increasing and decreasing the volume of the variable volume chamber.

19. The apparatus of claim 18 wherein the connector comprises an axial movement multiplier extending between the first and second pistons.

20. The apparatus of claim 12 wherein the biasing element is disposed within the first barrel section.

21. The apparatus of claim 12 wherein the biasing element is connected between the pump barrel and at least one of the first and second pistons.

22. The apparatus of claim 12 wherein the first and second pistons are operably configured for coordinated axial movement comprising:

axial movement in a first direction whereby the first piston moves away from the second barrel section while the second piston moves towards the first barrel section in response to the actuating pressure; and axial movement in a second direction, opposite to the first direction of axial movement, whereby the first piston moves toward the second barrel section while the second piston moves away from the first barrel section when the actuating pressure is decreased.

23. A method for producing accumulated liquids from a gas well, the method comprising:

positioning a fluid apparatus in a wellbore and forming an annulus therebetween, the fluid apparatus having:

a pump barrel having a first barrel section in fluid communication with a fluid source and a second barrel section in fluid communication with a discharge conduit;

a first piston housed in the first barrel section for axial movement therein;

a second piston housed in the second barrel section for axial movement therein, the first and second pistons defining a variable volume chamber between the first and second pistons;

a biasing element coupled to at least one of the first and second pistons;

an inlet check valve operable to permit fluid to flow from the fluid source to the variable volume chamber;

an outlet check valve operable to permit fluid to flow from the variable volume chamber to the discharge conduit;

a bypass passageway having an inlet end in fluid communication with the fluid source and an outlet end in fluid communication with the discharge conduit, the bypass passageway being in fluid communication with the variable volume chamber, wherein the inlet check valve is disposed at the inlet end of the bypass passageway and is operable to permit fluid to flow through the bypass passageway into the variable volume chamber and the outlet check valve is disposed at the outlet end of the bypass passageway and is operable to permit fluid to be discharged from the variable volume chamber through the bypass passageway; and a connector between the first and second pistons, the connector being operably configured to cause movement of the first piston in response to movement of the second piston;

producing gas to surface through the annulus to cause liquid to accumulate in the wellbore adjacent a distal end of the conduit;

cyclically applying an actuating pressure at the discharge conduit to cause the first and second pistons to move to increase the volume of the variable volume chamber thereby drawing accumulated liquid into the variable volume chamber through the inlet check valve while causing energy to be stored in the biasing element; and releasing the actuating pressure to permit the stored energy in the biasing element to cause respective return movement of the first and second pistons, the respective return movement of the first and second pistons being operable to reduce the volume of the variable volume chamber thereby causing fluid to be discharged from the variable volume chamber through the outlet check valve to the discharge conduit.

24. The method of claim 23 wherein applying and releasing the actuating pressure comprises continuously alternating applying and releasing the actuating pressure.

25. The method of claim 23 wherein applying and releasing the actuating pressure comprises intermittently alternating applying and releasing the actuating pressure.

26. The method of claim 23 further comprising:

sensing an accumulation of liquid in the wellbore adjacent the distal end of the conduit; and cyclically applying and releasing the pressure to pump the liquid into the discharge conduit.

27. The method of claim 23 wherein applying and releasing the actuating pressure comprises causing a hydraulic circuit to apply pressure to the discharge conduit.

28. The method of claim 23 wherein applying and releasing the actuating pressure comprises causing a plunger pump to apply pressure to the discharge conduit.

29. A fluid apparatus comprising:

a pump barrel having a first barrel section in fluid communication with a fluid source and a second barrel section in fluid communication with a discharge conduit;

a first piston housed in the first barrel section for axial movement therein;

a second piston housed in the second barrel section for axial movement therein in response to application of an actuating pressure to the discharge conduit, the first and second pistons defining a variable volume chamber between the first and second pistons;

a biasing element coupled to at least one of the first and second pistons;

a bypass passageway having an inlet end in fluid communication with the fluid source and an outlet end in fluid communication with the discharge conduit, the bypass passageway being in fluid communication with the variable volume chamber through at least one port, the bypass passageway further comprising:

(i) a first one-way valve means for permitting one-way fluid flow into the bypass passageway, the first one-way valve means being operable to facilitate fluid flow from the inlet end, through the at least one port, into the variable volume chamber; and (ii) a second one-way valve means for permitting one-way fluid flow out of the bypass passageway, the second one-way valve means being operable to facilitate fluid flow from the variable volume chamber, through the at least one port, and out the outlet end into the discharge conduit; and a connector between the first and second pistons, the connector being operably configured to cause movement of the first piston in a first axial direction in response to movement of the second piston in the first axial direction caused by the actuating pressure, the respective movements of the first and second pistons in the first axial direction being operable to increase the volume of the variable volume chamber thereby drawing fluid into the variable volume chamber through the first one-way valve means while causing energy to be stored in the biasing element, the stored energy in the biasing element being subsequently operable to cause respective movement of the first and second pistons in a second axial direction, opposite to the first axial direction, when the actuating pressure is decreased, the respective movement of the first and second pistons in the second axial direction being operable to reduce the volume of the variable volume chamber thereby causing fluid to be discharged from the variable volume chamber, through the second one-way valve means, and into the discharge conduit.

30. The fluid apparatus of claim 29 wherein at least one of the first one-way valve means and the second one-way valve means comprises a ball and seat check valve.

31. The fluid apparatus of claim 29 wherein at least one of the first one-way valve means and the second one-way valve means comprises a spring-loaded check valve.

32. The fluid apparatus of claim 29 wherein the first one-way valve means are positioned at the inlet end of the bypass passageway and the second one-way valve means are positioned at the outlet end of the bypass passageway.

33. The fluid apparatus of claim 29 wherein the connector comprises a rod.

* * * * *